US005929360A

United States Patent [19]

Szalay

[11] Patent Number: 5,929,360

[45] Date of Patent: Jul. 27, 1999

[54] METHOD AND APPARATUS OF PITCH RECOGNITION FOR STRINGED INSTRUMENTS AND STORAGE MEDIUM HAVING RECORDED ON IT A PROGRAM OF PITCH RECOGNITION

[75] Inventor: Andreas Szalay, Emmelshausen, Germany

[73] Assignees: BlueChip Music GmbH, Halsenbach, Germany; Yamaha Corporation, Hamamatsu, Japan

[21] Appl. No.: 08/978,218

[22] Filed: Nov. 25, 1997

[30] Foreign Application Priority Data

Nov. 28, 1996 [DE] Germany ..... 196 49 296

[51] Int. Cl.[6] ..... G10H 3/12

[52] U.S. Cl. ..... 84/616; 84/723; 84/725; 84/730; 84/DIG. 24; 84/654

[58] Field of Search ..... 84/602–603, 723, 84/725–726, 730, 731, 735, DIG. 24, 616, 654

[56] References Cited

U.S. PATENT DOCUMENTS

| | | | |
|---|---|---|---|
| 4,730,530 | 3/1988 | Bonanno . | |
| 4,991,488 | 2/1991 | Fala et al. . | |
| 5,308,916 | 5/1994 | Murata et al. | 84/603 |
| 5,367,120 | 11/1994 | Hoshiai | 84/654 |
| 5,717,155 | 2/1998 | Szalay | 84/723 |
| 5,780,759 | 7/1998 | Szalay | 84/454 |

FOREIGN PATENT DOCUMENTS

| | | |
|---|---|---|
| 0 288 062 | 10/1988 | European Pat. Off. . |
| 0 749 107 | 12/1996 | European Pat. Off. . |
| 43 43 411 | 6/1995 | Germany . |
| 195 00 750 | 7/1996 | Germany . |
| WO 95/16984 | 6/1995 | WIPO . |

*Primary Examiner*—William M. Shoop, Jr.
*Assistant Examiner*—Marlon T. Fletcher
*Attorney, Agent, or Firm*—Graham & James LLP

[57] ABSTRACT

There is provided a method of determining the pitch in string instruments that are excited by plucking or striking, wherein a vibration of a string is converted by a transducer into an electrical signal and the electrical signal is evaluated.

Up to now, the transducers have primarily been electromagnetic transducers for which a plurality of evaluation algorithms and methods are available. Now however, one also wants to be able to use pressure transducers without having to use new evaluation algorithms and methods.

To this end, a pressure transducer is used as the transducer and the electrical signal is subjected to differentiation with respect to time.

18 Claims, 2 Drawing Sheets

Figure 4:
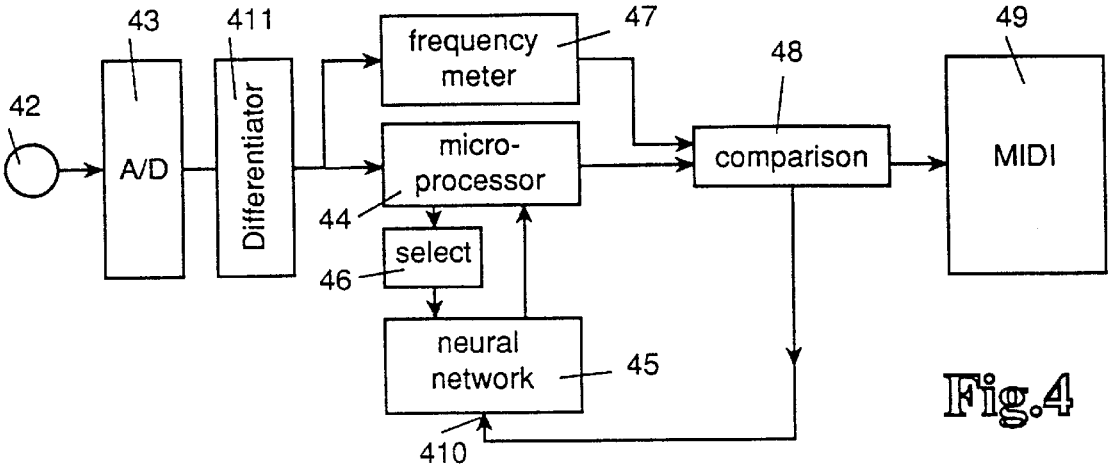

Fig.1
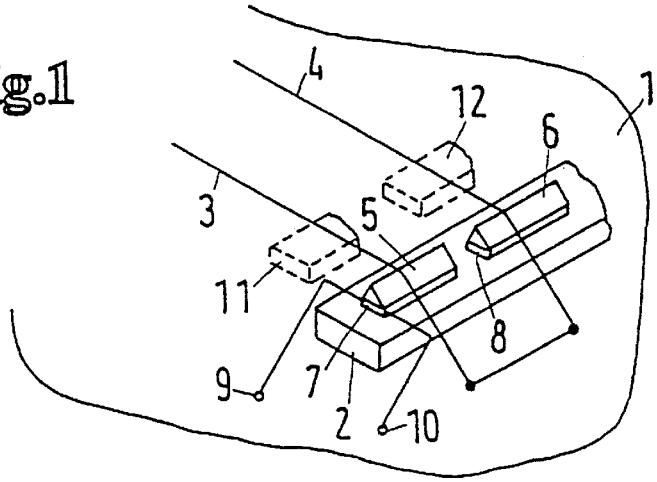
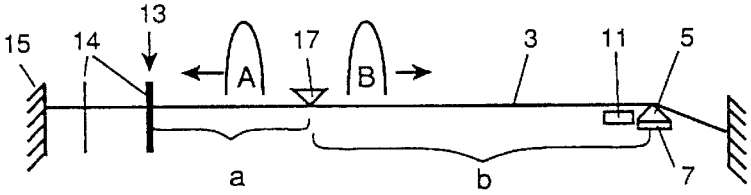
Fig.1a
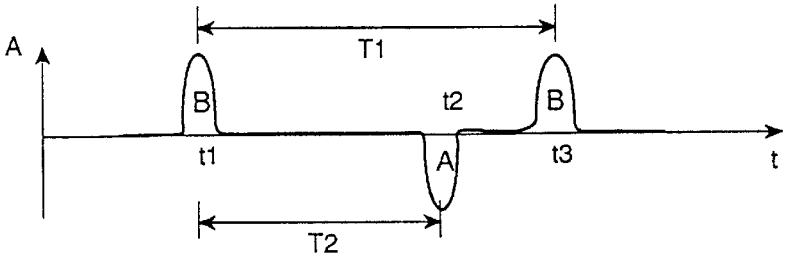
Fig.2a
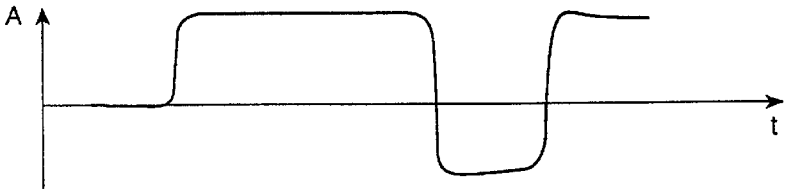
Fig.2b
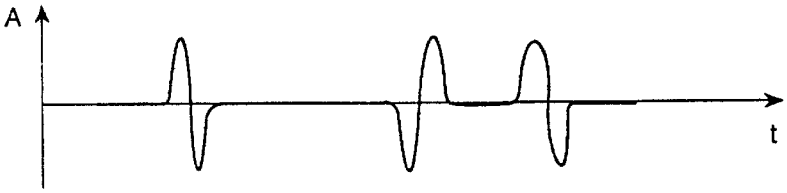
Fig.3a
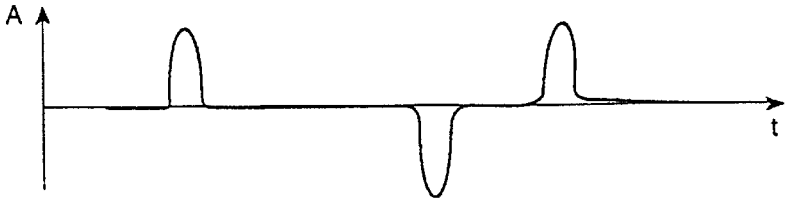
Fig.3b

METHOD AND APPARATUS OF PITCH RECOGNITION FOR STRINGED INSTRUMENTS AND STORAGE MEDIUM HAVING RECORDED ON IT A PROGRAM OF PITCH RECOGNITION

The invention relates to a method, an apparatus and a program of determining the pitch in string instruments that are excited by plucking or striking, wherein the vibration of a string is converted by a transducer into an electrical signal and the electrical signal is evaluated.

A method of this type is known from DE 43 43 411 A1. Methods of this type are used so that, following the striking of a string in a string instrument, information regarding the pitch that has been produced is available for further processing as quickly as possible, i.e. insofar as possible, before the string has reached its steady state.

Methods of this type are used predominantly in connection with electromagnetic transducers. The prerequisite therefor is that the strings be able to appropriately excite the electromagnetic transducer, i.e. in the general case, they should include at least one metallic component that will have an effect upon the electromagnetic field of the transducer and hence be able to produce a corresponding signal at the output of the transducer. This condition applies in the case of most so-called electric guitars. Since this has been one of the main applications of use up to now, there are a whole series of other methods available apart from the above-mentioned method in DE 43 43 411 A1, with the aid of which, the pitch of the struck or plucked string can be determined.

However, the restriction to electromagnetic transducers is disadvantageous. Thus, players, who are used for example to an acoustic guitar wherein some or all of the strings are formed from strings of synthetic material, cannot partake of the advantages of a rapid synthesising procedure for the sounds that they have produced. The same thing also applies for other string instruments that are struck or plucked.

Here too, one would like to have the opportunity to have the corresponding pitch information available as directly as possible following the excitation of the string. For this, it is not just the actual or expected frequency of vibration of the string that is to be determined. One must also be able to evaluate the signals resulting from the movement of the string in as simple a manner as possible.

It is in itself known to pick-up the vibrations of a string by means of a pressure transducer. The signal resulting therefrom can then be amplified and reproduced over a loudspeaker for example. If there is enough time available, the signal can also be used for synthesizing purposes. However, usage of the signals obtained thereby for a rapid synthesizing process, along the lines of DE 43 43 411 A1 perhaps, has not been possible up to now because the form of the signals from pressure transducers is not suitable therefor. The development of appropriate signal handling processes is relatively expensive. It would be more advantageous if one could use the procedures developed for electromagnetic transducers.

Accordingly, the object of the invention is to provide ways in which the same evaluation procedures can be utilized with different transducers.

This object is achieved in the case of a method of the type mentioned herein above in that a pressure transducer is used as the transducer and the electrical signal is subjected to differentiation with respect to time.

Following the differentiation or forming the derivative with respect to time of a signal obtained with the aid of a pressure transducer upon the excitation of a string, there is made available a signal whose structure has a very great similarity to the structure of an output signal from an electromagnetic transducer. This is somewhat surprising insofar as the output signals from electromagnetic transducers and pressure transducers are basically of a completely different nature and hence a comparable processibility would not have been expected. Although this has not yet been definitely settled, it is taken for the moment that an electromagnetic transducer produces a signal by virtue of the movement of the string. In the widest sense therefore, we are concerned with a movement sensor. A pressure transducer detects the actual pressure that the string is producing. This pressure alters with the excitation of the string and the vibrations resulting therefrom. Thus, it consists of a constant part, which is of no further interest for the moment, and a variable part which is producing the output signal. This pressure and hence the output signal is proportional, in the main, to the displacement with time of the corresponding position of the string so that one can consider the pressure transducer as being a position sensor. Since the movement function is a derivative of the position function with respect to time, one can obtain a signal, which corresponds to a large extent to the signal from an electromagnetic transducer, by differentiating the position function with respect to time.

One thereby gains the considerable advantage that one merely has to provide one single processing routine that can be used in conjunction with an electromagnetic transducer as well as in conjunction with a pressure transducer. When using a pressure transducer, one merely needs to precede this process with one further method step, namely, the formation of the derivative with respect to time. One is thereby spared not just from having to develop another complete processing routine for a pressure transducer but one also saves on the memory needed therefor and the processing capacity needed thereby.

By means of the method provided, one is even able to transfer the characteristic properties of differing stroking or plucking techniques. Thus, for example, it makes a considerable difference as to whether the player plucks the string with a plectrum which is directed perpendicularly to the body of the guitar or whether he holds the plectrum at an angle of approximately 45° Due to the differentiation with respect to time, the signal from the pressure transducer is in both cases (and naturally too, for the corresponding intermediate values) transformed such that it can be further processed in the same manner as a signal from an electromagnetic transducer whilst retaining the same information.

Preferably, a piezo-electric transducer is used for the pressure transducer. Piezo-electric transducers are relative small. They have a short reaction time and accordingly contribute very little to the time necessary for processing the electrical signals following the plucking process.

It is of advantage if the electrical signal is digitized before being evaluated. A plurality of processing routines are available in the digital field with the aid of which one can deduce the pitch information from the output signal of the transducer.

It is particularly preferred hereby that the digitilization process be effected at a constant sampling rate and that the differentiation be effected by forming the differences between sampling values which are mutually spaced apart in time by a constant predetermined amount. One is thereby saved from the additional processing step of forming a quotient. By virtue of the constant temporal spacings, the formation of the difference is sufficient for obtaining the same information as would otherwise emerge from a digital differentiation process.

It is particularly preferred hereby that the spacing be selected such that there is an increase from 10% to 90% of the maximum value of the signal in the interval formed thereby, at least for one predetermined state of tension in the string. The choice of spacing depends on two important factors: the sampling rate and the slope of the signal. If one selects the spacing such that there is an increase from about 10% to about 90% of the maximum value of the signal in this time, then, to a close approximation, one can proceed on the basis that the differentiation at this spacing will provide a relatively exact picture of the information contained in the signal with respect to further processability as a signal from an electromagnetic transducer. If the spacing is smaller, then the fraction of signal peaks declines in comparison with the high frequency noise or interference peaks that are always present in a signal of this type. If the spacing is too great then the derivative no longer has an approximately Gaussian shape as is wanted but rather, is in the form of a trapezoid whereby the similarity to the signal from an electromagnetic transducer is again impaired. The slope of the signal is dependent, inter alia, on the frequency of the tone that is being produced by the string. Since different strings are generally provided in a string instrument for producing different pitches, the temporal spacing for the different strings may also be of different amounts. Different sounds can also be produced with a single string. In the case of a guitar for example, different taps or frets are provided for this purpose. It is sufficient hereby for example, if one selects the middle one of the tones that are producible by the corresponding string, or, the tone produced most frequently by the string as determined by experience, as being the basis for the temporal spacing.

In a particularly preferred embodiment, it is provided that, following the differentiation, the temporal spacing of the pulses or groups of pulses in the form of plucked-transients be detected and evaluated as a transit time or a transit time difference in order to produce a signal representing the pitch. If one effects an evaluation in this manner, one no longer has to wait until the string has reached its steady state. By virtue of the differentiation, one can also obtain the so-called plucked-transients from the output signal of the pressure transducer i.e. those in the pulses or groups of pulses of a wave excitation that runs to and fro on a string before a steady state of the string occurs. By virtue of the transit times or transit time difference of these plucked-transients, a signal can then be obtained that contains the pitch information.

It is preferred hereby that the polarity of the pulses or groups of pulses should also be detected and that a signal be determined from the temporal sequence of the pulses or groups of pulses which represents the position at which the string is being excited. One thereby also obtains information regarding the location of the excitation. With the aid of this information, one can better incorporate the manner of expression and the way in which the player plays into the synthesizing process for the signals.

The invention will be described hereinafter by means of a preferred embodiment taken in conjunction with the drawing.

Therein

Figure 5:
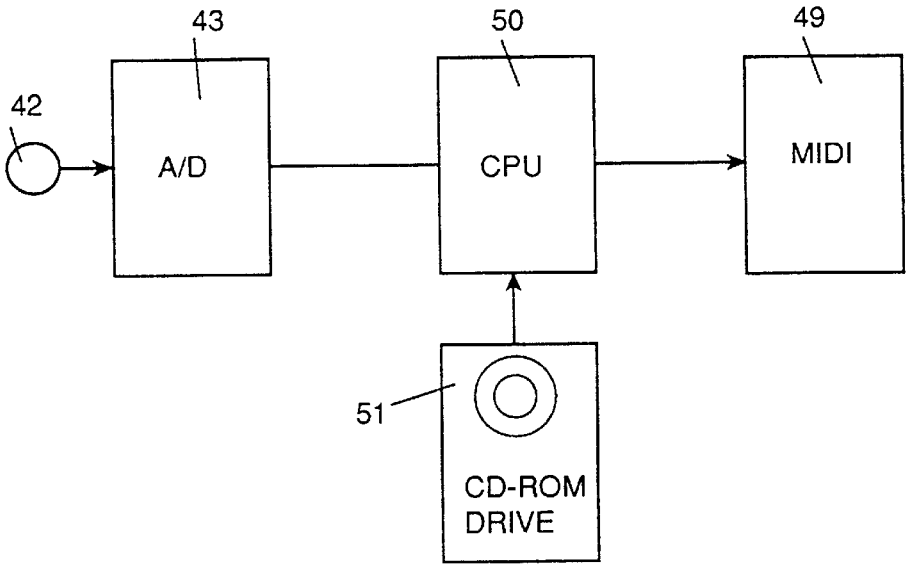
Figure 6:
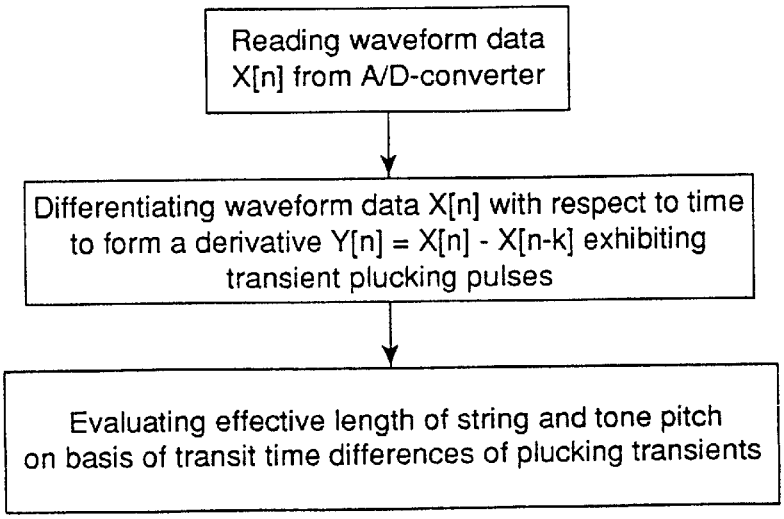

FIG. 1 shows a schematic view of a string instrument having two strings,

FIG. 1*a* shows a schematic view of the string of FIG. 1 suspended between two points, FIGS. 2*a* and 2*b* show schematic waveforms when a string is struck with a plectrum in a first position FIGS. 3*a* and 3*b* show the corresponding waveforms when a string is struck with a plectrum at an angle of 45°, FIG. 4 shows a block diagram of an apparatus for recognition of a tone pitch, FIG. 5 shows an apparatus for recognition of tone pitch using a program stored on a CD-ROM and FIG. 6 shows the main steps of the program stored on the CD-ROM of FIG. 5.

FIG. 1 shows in schematic manner, a body 1 of a guitar having a bridge 2 over which pass two strings 3, 4. In reality, a guitar has substantially more strings, six or twelve for example. However one string suffices for the purposes of explanation.

A strut 5, 6 is provided on the bridge 2 for each of the strings 3, 4. A respective piezo-electric element 7, 8 serving as a pressure transducer is arranged between the supports 5, 6.

Each piezo-electric element 7, 8 is provided with two terminals 9, 10 (only those for the piezo-electric element 7 are illustrated). A voltage proportional to the pressure on the piezo-electric element 7 can be tapped off from the terminals 9, 10.

Moreover, the electromagnetic transducers 11, 12 are also illustrated in schematic manner. Electromagnetic transducers 11, 12 of this type are arranged very closely under the appertaining strings 3, 4 i.e. at a distance of one mm for example. They are only sketched there so as to enable a comparison between the output signals of the piezo-electric transducers 7, 8 and the output signals of the electromagnetic transducers 11, 12 to be made. In reality, a guitar or a similar musical instrument will either have electromagnetic transducers 11, 12 or piezo-electric elements 7, 8.

FIG. 1*a* shows schematically the string 3 which is strung between a fixed clamping point constituted by strut 5 and a clamping point 15 at which the tension can be set. The string 3 stretches over a guitar neck (not shown) on which there are arranged various frets 14. Shown by an arrow 13 is one fret on which the string 3 is pressed down. This fret together with the strut 5 determines the effective length L of the string 3. The electromagnetic pick-up 11 is arranged under the string. By means of a triangle 17, which is intended to symbolize a plectrum or a similar plucking implement, a position of excitation for the string 3 is shown. If the string 3 is now plucked or struck at this position of excitation a standing wave of the frequency which is characteristic of the pitch is not established directly. Rather, a transient process begins, which can be described in a simplified way by saying that two pulses designated A and B run to the left and the right from the position of excitation. The pulse A runs to the left as far as the fret 13 on which the string is held down. There it is reflected, with phase reversal and runs back once more. In the same way the pulse B runs to the right as far as the clamping point consisting of the strut 5, where it is reflected, with phase reversal and runs back once more. The pulses or waves, running to and fro, overlay one another and after a short time they form the standing wave with which the string 3 oscillates.

The pulses A and B run past the electromagnetic pick-up 11 which is very close to the strut 5 and is assumed here to coincide locally with the strut 5.

A corresponding time diagram is shown in FIG. 2*a*. It can be seen here that the pulse designated B which is intended to have a positive amplitude crosses the pick-up 11 at a time t1.

At time t2 the pulse designated A which was reflected at the fret 13 and phase-inverted arrives at the electromagnetic pick-up 11. Finally at time instant t3 the electromagnetic pick-up 11 senses again the pulse B after it has travelled over the string a second time and after having been phase-inverted for the second time at fret 13.

The velocity of motion or the travelling velocity of the pulses A and B on the string 3 is known. The active length of the string 3 and hence the tone pitch can be determined from the time difference T1, which is, the difference between the times t1 and t3. Since T1 is the time required for traversing the string two times the effective length L of the string can be calculated as L=v·T1/2, where v is the travelling velocity of the pulses.

The total length L of the string 3 is intersected by the plucking point into two parts a and b in such a manner, that a+b=L. In order to determine the position of the plucking point the time interval T2 between time instant t1 and time instant t2 must be evaluated. The arrival of the pulse A at the electromagnetic pick-up 11 is delayed with regard to the first arrival of the pulse B because the pulse A first travels away from the electromagnetic pick-up and has therefore to travel a way which is longer than the way to be travelled by the pulse B. The additional way which must be travelled by pulse A is equal to 2a. Therefore the distance a can be calculated as a=v·T2/2.

When a string is struck or plucked at a predetermined position of excitement, the signal waveform is very dependent on the type of excitation even in the case of a constant exciting force. This will be made clear with the aid of FIGS. 2 and 3. FIG. 2 shows signal waveforms in the case of excitation by a plectrum which is held approximately perpendicularly to the surface of the body 1. FIG. 3 shows the corresponding waveforms when a string is struck by a plectrum which is held at an angle of 45° to the body 1. Hereby, the signal waveform that occurs on the electromagnetic transducer 11, 12 is illustrated in the parts a of the Figures, whilst the signal waveform that occurs on the terminals 9, 10 of the piezo-electric element 7 or 8 is illustrated in the parts b of the Figures.

If the plectrum is held somewhere between the two extreme positions, the signal waveform changes accordingly and will adopt an intermediate value between the two signal waveforms illustrated. This applies for the electromagnetic transducer as well as for the piezo-electric element.

All four signal waveforms are only illustrated schematically. They serve for the purpose of explaining the effects occurring in a qualitative manner.

The piezo-electric element 7, 8 is a pressure sensor that determines the instantaneous pressure of the string which is tensioned over the strut 5, 6 on the piezo-electric element 7, 8. The pressure on the piezo-electric element 7, 8 has a constant part which is dependent on the basic tension in the string and is of no interest here for the moment, and a variable part which produces the electrical signals. This pressure is proportional to the instantaneous displacement of the string. One can deduce therefrom that the piezo-electric element 7, 8 can be used here as a position sensor.

By contrast, the electromagnetic transducer 11, 12 is a movement sensor because it produces an electrical voltage when a corresponding string 3, 4 is moved in an inhomgeneous magnetic field of the transducer magnets. This presupposes of course that the string can interact with this field. As a rule, strings made of synthetic material are not able to do this. Rathermore, metal strings and in particular steel strings are required.

Thus, while the piezo-electric element 7, 8 is a position sensor, the electromagnetic transducer is a movement sensor.

The movement is the derivative with respect to time of the position signal. If one views the piezo-electric element 7, 8 as a movement sensor, then the electromagnetic transducer 11, 12 forms a speed sensor. One can thus derive the output signal of the piezo-electric element 7, 8 with respect to time in both cases and obtain a signal which is very similar to that from the electromagnetic transducer 11, 12.

FIG. 2*b* depicts a rising slope at the beginning. In correspondence therewith, FIG. 2*a* has a pulse at this position. At the next alteration of the signal in FIG. 2*b*, this signal has a negative slope, while in correspondence therewith, there is a negative pulse in FIG. 2*a*, and so on.

Similar relationships can be observed in the case of a comparison of FIGS. 3*a* and 3*b*. If FIG. 3*b* exhibits a positive pulse having a rising and a falling edge, then, in correspondence therewith, the signal waveform of FIG. 3*a* firstly shows a positive peak and then a negative peak.

Since evaluating algorithms for the output signals of electromagnetic transducers 11, 12 are known, and a preprocessing of a signal can be achieved by the simple process of obtaining the derivative with respect to time from the piezoelectric elements 7, 8 then it is also possible to convert the output signals produced by the piezo-electric elements with the aid of conventional processing techniques.

The processing of signals in systems of this type frequently occurs in digital manner. Accordingly, the output signals of the corresponding sensors i.e. the electromagnetic transducers 11, 12 or the piezo-electric elements 7, 8, pass through an analog-digital conversion process. If thereby the sampling rate is kept constant, at 10 kHz for example, then it suffices for the differentiation or formation of the derivative with respect to time if one forms the differences between individual sampling values, these samples not necessarily having to follow one another directly but they could also be separated from each other by a predetermined number of samples. The derivative Y [n] from a signal X [n] then results for example from the following equation:

$$Y[n]=X[n]-X[n-k]$$

wherein X [n] constitutes the sampling value, whilst Y [n] forms the current output value of this conversion, k is a constant value.

The selection of this value k, i.e. the selection of the spacing in time between the samples which are drawn upon for forming the derivative with respect to time, is important to the applicability of the process. It depends on two factors, namely, the sampling rate and the slope of the signal. The value k should be selected such that it is equal to the number of samples that delineate the steep climb of the signal from 10% to 90% of its maximum value. However, since this value is also dependent, inter alia, on the tone produced by the strings 3, 4, one can be very nearly satisfied by employing here an average value for each string.

If the value k is smaller, then the proportion of signal peaks compared to the high frequency interference peaks that are always present in the signal will decrease. If the value k is too large, the derivative will lose its similarity to the signal from the electromagnetic transducers.

As described above with regard to FIGS. 1*a* and 2*a* the effective length of the string as well as the position of the plucking point can be determined by measuring the time interval between the transient pulses travelling over the string. Nevertheless, the measurement of time for determining the interval between the pulses is occasionally subject to uncertainties. For this reason the evaluation of the pulses is made in an arrangement as shown in FIG. 4.

A guitar has normally six strings, however for the sake of simplicity only the signal analysis for one string is discussed with reference to the signal analysis device of FIG. 4. Provided for each string is a pick-up 42, which, for example, can be a piezoelectric sound pick-up. The pick-up 42 is coupled to an analog/digital-converter 43 which has one channel for each pick-up 42. The analog/digital-converter 43 is connected to a differentiator 411, the output of which is connected to a microprocessor 44 which provides the input and output management for a neural network 45. A selection device 46 can also be provided between the microprocessor 44 and the neural network 45, the function of which selection device will be described later.

Moreover the analog/digital-converter 43 is connected to a frequency meter 47. The frequency meter 47 and microprocessor 44 are connected to a comparisons device 48. The comparison device 48 is connected to a MIDI interface 49. The comparison device 48 is likewise connected to the neural network 45, to be specific, to a learning input 410.

Under the management of the microprocessor 44 and, if appropiate, conditioned by the selection device 46, the neural network 45 receives a sequence of pulses or groups of pulses and classifies these sequences in each case into one of a multiplicity of specific classes. Here, each class allows a conclusion as to the pitch and, if appropiate, also as to the position of a excitation of this string.

By using the selection device 46, individual pulses are selected from the sequence of groups of pulses which are registered by the pick-up 42 and said individual pulses are fed to the neural network 45. The neural network can identify similarities between individual sequences of groups of pulses and classify the "plucking transients", which are represented by these sequences of pulses, in such a way that their assignment to individual classes, which in each case reproduce a pitch and a position of excitation, is possible with great certainty. The identification sequence is triggered here by the occurring pulses. The successive positive and negative pulses or groups of pulses are forwarded to the neural network, which tries on each occasion to assign the pattern pick-up or the sequence pick-up to a previously learned sequence. This detection sequence is repeated until either the neural network has produced a positive result or the frequency meter 47 has provided the corresponding information. If the neural network is still in the learning or training phase, in many cases the frequency meter will be quicker. However, after a certain training phase, the neural network 45, which can itself form the rules for the identification if it is programmed accordingly, has stored sufficient information to be able to undertake the classification itself in a extraordinarily effective manner. The neural network 45 also forms specific rules for generalities, so that even patterns which have not been learned specifically can be identified, providing these have specific similarities to the examples already learned.

Since the frequency meter undertakes a pitch identification in parallel, further learning is also possible during the operation of the signal analysis device. The comparison device 48 compares the pitch determined by the neural network 45 with one determined later by the frequency meter 47. Here, it is possible on the one hand to follow the fine pitch changes, which are a means of expression of the player, on the other hand, using this procedure, errors or inaccuracies in the algorithm which is applied by the neural network 45 can be discovered and eliminated. The comparison device 48 specifically couples the determined error back into the neural network 45 and triggers a new learning algorithm, so that the same error can not occur again, as a result of the improved identification capability. In the event that no difference occurs, the comparison device 48 forwards the signal or signals unchanged to the MIDI-interface 49.

The output results of the neural network are processed further in such a way that the MIDI-interface 49 can make MIDI-signals available, which can drive a MIDI-synthesizer or an expander module. The pitch encoded in the MIDI-signal corresponds in this case to the pitch of the guitar string. Moreover, the plucking position can also be contained in the MIDI-signal as monitoring information, as an encoded sound quality character.

The above description of the signal analysis device includes a differentiator 411 coupled to the output terminal of the analog/digital-converter 43. Due to the use of this differentiator 411 a pressure transducer such as a piezo-transducer 42 can be used and nevertheless the signal processing in parts 44 to 48 can remain the same as for processing output signals of an electromagnetic sensor.

A zero adjustment analysis such as is known from DE 195 00 750 A1 may then be appended to the formation of the derivative function.

Instead of implementing the tone recognition apparatus by hardware as described above in connection with FIG. 4 it can also be implemented by software.

FIG. 5 shows an embodiment of the invention comprising an A/D-converter 43, a central processing unit (CPU) 50 connected to the output of the A/D-converter and a MIDI-interface 49 connected to the output of the CPU 50. The CPU 50 receives a program from a CD-ROM drive 51.

FIG. 6 shows the essential steps of the program which is recorded on the CD-ROM of the CD-ROM drive 51. It consists of the steps of reading waveform data X[n] from the A/D-converter 43, differentiating said waveform data X[n] with respect to time to form a derivative $$Y[n]=X[n]-X[n-k]$$

exhibiting transient plucking pulses and evaluating the effective length of the string and tone pitch on the basis of the transit time differences of the plucking transients.

I claim:

1. A method of pitch recognition for stringed instruments activated by plucking or striking, in which an oscillation of a string induced by plucking or striking is converted by means of a pick-up into an electrical signal and the electrical signal is evaluated, wherein a pressure pick-up is used as the pick-up, the electrical output signal of the pressure pick-up is subjected to a differentiation with respect to time and a pitch of a tone signal corresponding to the plucking or striking is evaluated based on the signal obtained by differentiation.

2. A method according to claim 1, wherein a piezo-electric transducer is used as the pressure pick-up.

3. A method according to claim 1, wherein the electrical signal is digitized before being evaluated.

4. A method according to claim 3, wherein the digitalization process is effected at a constant sampling rate and the differentiation is effected by forming the difference of the sampling values which are mutually spaced apart in time by a constant predetermined amount.

5. A method according to claim 4, wherein the spacing is selected such that there is an increase from 10% to 90% of the maximum value of the signal in the interval formed thereby at least for one predetermined state of tension in the string.

6. A method according to claim 1, wherein following the differentiation wherein pulses or groups of pulses are formed as plucked-transients, the temporal spacing of the pulses or groups of pulses formed as plucked-transients is detected and evaluated as a transit time or transit time difference in order to produce a signal representing the pitch.

7. A method according to claim 6, wherein a polarity of the pulses or groups of pulses is also detected and a signal is determined from the temporal sequence of pulses or groups of pulses which represents the position at which the string is being excited.

8. A tone pitch recognition apparatus for determining the tone pitch of a musical tone of a string instrument having at least one string suspended between two end points, said tone pitch recognition apparatus comprising:

a pressure transducer provided at one of said end points of said at least one string providing an electrical pressure signal, a differentiator means coupled to said pressure transducer for generating a derivative with respect to time of said pressure signal said derivative exhibiting pulses in the form of transients obtained by plucking or striking of said at least one string, and evaluating means coupled to said differentiator means for obtaining a tone pitch value of said at least one string on the basis of time spacings of said pulses of said transient.

9. An apparatus according to claim 8, wherein an A/D-converter is interposed between said pressure transducer and said differentiator means.

10. An apparatus according to claim 9, wherein said evaluating means comprises:

a microprocessor coupled to an output of said A/D-converter, a frequency meter coupled to an output of said A/D-converter, and a comparison device coupled to outputs of said microprocessor and said frequency meter, a neural network having an input and a learning input, said input being coupled to said microprocessor and said learning input being coupled to said comparison device.

11. A computer readable storage medium having recorded on it a program for determining the tone pitch of a musical tone of a string instrument having at least one string suspended between two end points, said program comprising at least the following steps:

reading digitized waveform data X[n] from an A/D-converter differentiating said waveform data X[n] with respect to time to form a derivative $Y[n]=X[n]-X[n-k]$ exhibiting transient plucking pulses, k being a constant integer and processing said derivative Y[n] to evaluate the effective string length and tone pitch data on the basis of time spacings of said transient plucking pulses.

12. A machine-readable recording medium containing program instructions executable by said machine for causing said machine to perform a method of pitch recognition for stringed instruments activated by plucking or striking comprising the steps of:

converting an oscillation of a string induced by plucking or striking into an electrical output signal, through the use of a pressure pick-up;

differentiating the electrical output signal of the pressure pick-up with respect to time; and evaluating the electrical output signal obtained by differentiation, including processing said electrical signal in a manner suitable for signals of an electromagnetic pick-up.

13. The machine-readable recording medium of claim 12 wherein a piezo-electric transducer is used as the pressure pickup.

14. The machine-readable recording medium of claim 12 wherein the electrical output signal is digitized before being evaluated.

15. The machine-readable recording medium of claim 14, wherein the digitalization process is effected at a constant sampling rate and the differentiation is effected by forming the difference of the sampling values which are mutually spaced apart in time by a constant predetermined amount.

16. The machine-readable recording medium of claim 15, wherein the spacing of the sampling values is selected such that there is an increase from 10% to 90% of the maximum value of the signal in the interval formed thereby at least for one predetermined state of tension in the string.

17. The machine-readable recording medium of claim 12 wherein following the differentiation, the temporal spacing of the pulses or groups of pulses formed as plucked-transients is detected and evaluated as a transit time or transit time difference in order to produce a signal representing the pitch.

18. The machine-readable recording medium of claim 17 wherein the polarity of the pulses or groups of pulses is also detected and a signal is determined from the temporal sequence of pulses or groups of pulses which represents the position at which the string is being excited.

* * * * *